United States Patent [19]

Gaetano

[11] 4,212,261

[45] Jul. 15, 1980

[54] GOLF SCORE KEEPING DEVICE

[76] Inventor: John Gaetano, 1143 Crane St., Suite D, Menlo Park, Calif. 94025

[21] Appl. No.: 6,270

[22] Filed: Jan. 25, 1979

[51] Int. Cl.[2] ..... A63B 71/06

[52] U.S. Cl. ..... 116/224; 116/312; 116/318; 116/324; 40/441

[58] Field of Search ..... 116/224, 225, 223, 222, 116/324, 323, 321; 235/1 B, 88 G; 35/75, 31 E; 40/491, 488, 490, 16, 18

[56] References Cited

U.S. PATENT DOCUMENTS

| | | | |
|---|---|---|---|
| 1,468,143 | 9/1923 | Eldridge | 116/225 |
| 1,811,778 | 6/1931 | Bowen | 116/225 |
| 3,455,273 | 7/1969 | Willinghan | 116/223 |
| 3,485,204 | 12/1969 | Christman | 116/324 |
| 3,584,597 | 6/1971 | Simmons | 116/225 |

FOREIGN PATENT DOCUMENTS

| | | | |
|---|---|---|---|
| 607981 | 9/1948 | United Kingdom | 40/491 |

*Primary Examiner*—Gerald Goldberg
*Assistant Examiner*—Denis E. Corr
*Attorney, Agent, or Firm*—Alfons Puishes

[57] ABSTRACT

A device for keeping a golf score comprises two flat panels fastened to provide a space in between. The first face is equipped with nine horizontal slots, numbered 1 to 9 and the second face an equal number of slots numbered 10 to 18 representing the holes on a golf course. Indicating runners or slides operate in these slots which are equipped with stops providing spaces and numbers from 0 to 10 for each slot representing the number of strokes per hole. Indicating slots are of novel construction so as to be easily moveable and yet may be readily arrested and held in place opposite the number corresponding to the strokes taken by the player. Numbered wheels are provided for totalizing the score as the game progresses.

4 Claims, 7 Drawing Figures

GOLF SCORE KEEPING DEVICE

BACKGROUND OF THE INVENTION

Score keeping devices for such games as tennis, baseball, etc., have been in use for some time. The applicant is not aware of any device particularly adapted for golf. The score is currently kept by entering the number of strokes on a score card with a pencil and then totaling these at the end of the game. A device such as that covered by the present invention provides and easy and positive method of keeping an individual score and thus simlifies the task of score keeping.

SUMMARY OF THE INVENTION

I have invented such a device which is simple, convenient and accurate in keeping an individual golf score. It is also small in size and may be kept to dimensions of 3" by approximately 5" and is easily attachable to the person of the player or to his golf bag.

My device comprises essentially two flat panels fastened together with a space in between. My front panel contains nine horizontal slots numbered 1 through 9 and my rear panel contains an equal number, numbered 10 to 18. Each slot represents one hole of a golf course. Each horizontal parallel slot is graduated along its length in numbers of 0 to 10 for each slot representing the number of strokes taken on each hole. A novel indicator slide is arranged to be positioned in the space between the panels and rides in the slots. The slots in turn are equipped with stops on either side of each numbered graduation for strokes and the indicator slide is so constructed that it may be caused to stop opposite any number desired. The number, of course, represents the number of strokes taken on the hole. The stop is positive in nature and while the slide may be readily moved, it cannot be accidentally moved from one number to another because of the novel construction of the slides and the stops.

Basically, the indicating portion of the slide which protrudes through the slot is in effect a push button which may be depressed against spring legs on the slide to permit it to slide by the stops. When released, the indicator rises in the appropriate space opposite the number which it is desired to record.

Notched wheels arranged in a pair and graduated from 0 to 9 around their circumference are positioned between the two panels, and windows are provided through a panel to show the total score at any given time.

The device is equipped with a means of fastening either to the person of the player or to his golf bag for convenience.

DESCRIPTION OF A PREFERRED EMBODIMENT

Figure 3:
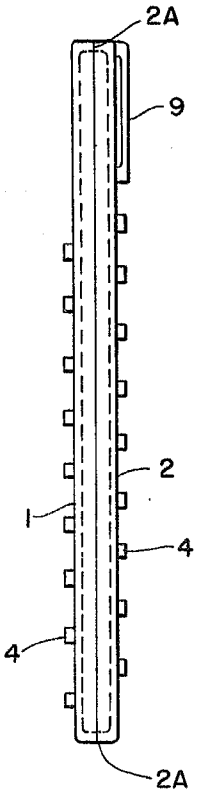
FIG. 3 is a side view of my device.
Figure 2:
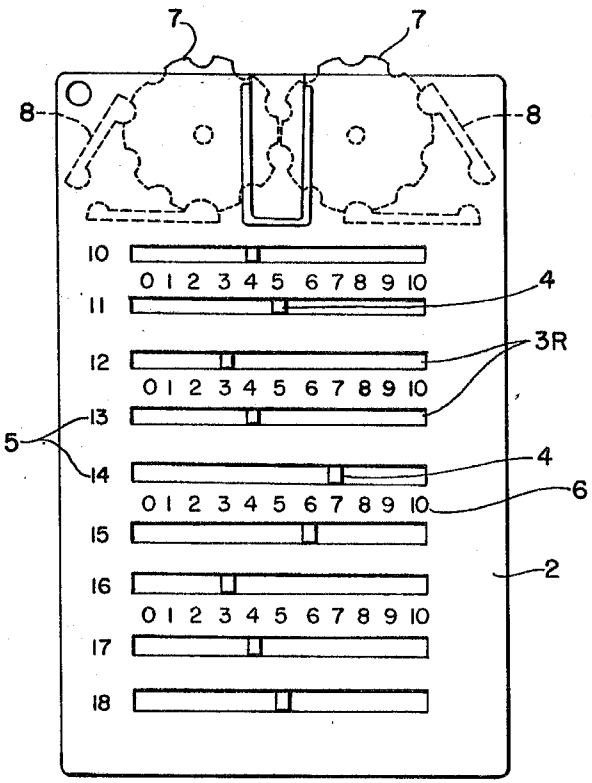
FIG. 2 is a rear view of my device showing the rear panel.
Figure 1:
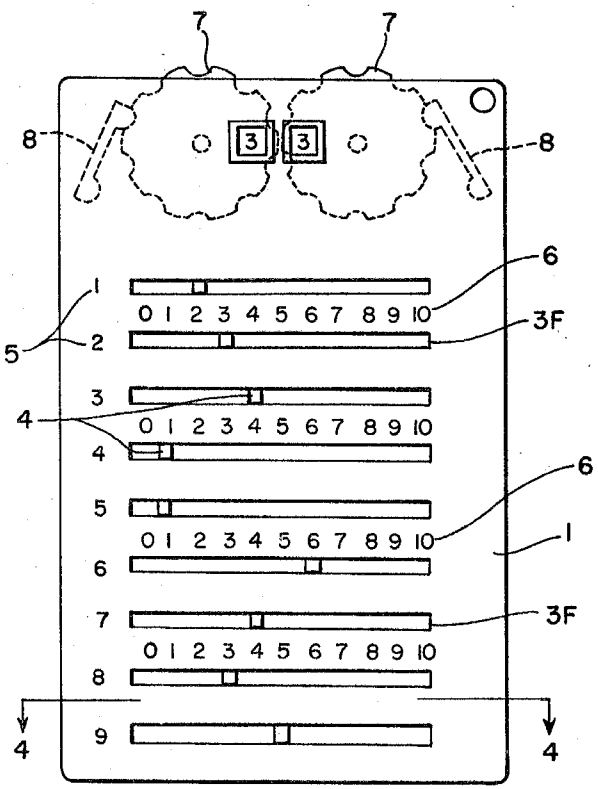
FIG. 1 is a front view of my device showing the front panel.
Figure 4A:
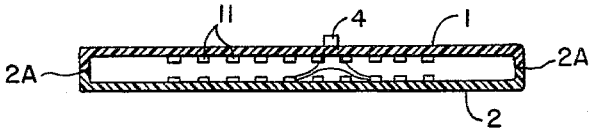
FIG. 4A is a view of a section along 4—4 of FIG. 1.
Figure 4B:
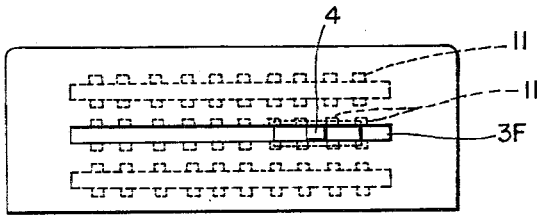
FIG. 4B is a top view of the section of FIG. 4A.
Figure 5:
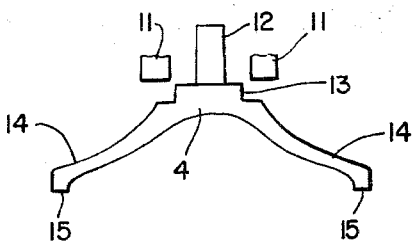
FIG. 5 is a side view of one of the indicator slides in a depressed position as on moving from one number to another.
Figure 6:
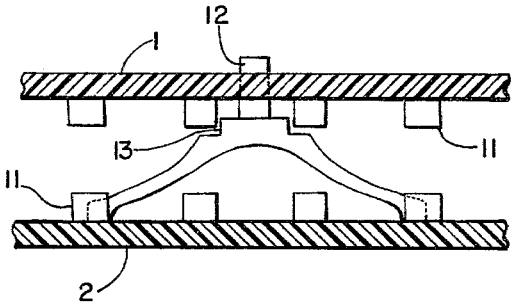
FIG. 6 is an enlarged partial section showing the operation of the indicators between the panels in position.

Referring first to FIGS. 1, 2 and 3, there is seen the front panel 1 and the rear panel 2. These are shaped and joined at 2A to provide a hollow space in between. Nine horizontal slots are located through panel 1 and numbered 1 through 9. An additional nine slots are located in rear panel 2 and shown at 3R. These are graduated with numbers 10 to 18. Each slot thus represents the corresponding hole on an 18 hole golf course. Each slot contains a series of graduations from 0 to 10 along its length which represent the number of strokes taken on a particular hole. These are shown at 6. The numbers may be stamped on by any convenient means. Since I prefer to manufacture my device from plastic, these numbers will be hot stamped on the surface of the panels.

A pair of totalizing wheels equipped with notches or teeth and engaging spring pawls 8 are likewise located between the panels. These bear graduations of 0 to 9 around the circumference, the numbers being visible through windows 8A as shown. These numbers indicate the total strokes taken at any given time and may be positioned by turning the wheels which project slightly beyond the outer periphery of the panels. A fastening clip 9 is provided for fastening the device to the clothing of the player and a hole 10 for the tieing to a golf bag if desired.

Referring now to FIGS. 4A, 4B, 5, and 6, there are seen the details of the construction and operation of my indicators in relation to the rest of the device. A series of stops 11 are positioned on the interior surface of the panels along the slots and so positioned that there is a stop on either side of each numbered of the graduations representing the strokes. A portion of the indicator 4 seen at 12 projects through the slots. The indicator is equipped with a hub or enlarged section defining an engaging ledge 13 which is designed to slip in between the stops 11. The spring arms 14 form a part of the indicator as do the sliding legs 15. The action of the spring legs which, of course, are made of a springy material, is such as to urge the projection of the indicator slides upward through the slot and opposite any desired number. When it is desired to move the indicator to the proper number, the slot is depressed by pressing down on the projection 12 so that the engaging ledge 13 clears the stops 11 and, in fact, rides against these until the engaging ledge 13 clears a pair of stops, at which point the projection is permitted to spring outward opposite the desired number. In this manner, the number of strokes may be shown by indicator 12 on panel 1 or 2.

It is evident from the above that the positioning of my indicators is positive in nature preventing accidental motion and alteration of the score. The totalizing wheel may be positioned after each hole adding the particular score as described above.

As indicated above, I may mold my device in plastic, joining the two halves at 2A by ultrasonic or other means. The stops 11 may be made an integral part of the respective panel with 1 and 2 as desired.

As seen from the drawings, slots on the rear panel are staggered to straddle the slots on the front panel so that there will be no interference with the operation of the slides, the sliding legs of which 15 ride on the inner surface of the opposite panel in each case.

I claim:

1. A device for keeping a golf score comprising:

a pair of rectangular oppositely faced panels joined at their periphery to define a space there between;

nine parallel horizontal slots positioned at regular intervals through the first of said panels and bearing graduations 1 through 9 opposite one end of each slot respectively;

nine parallel horizontal slots positioned at regular intervals through the second of said panels, said slots being staggered in relation to said slots in said first panel and bearing graduations of 10 through 18 opposite one end of each slot respectively;

numbers 1 to 10 positioned at equally spaced intervals along each of said slots; slide means positioned in said space between said panels disposed for horizontal movement along said slots and having an indicator means projecting through said slots;

said indicator means forming a part of said slide means;

a plurality of series of positive stops positioned along each side of said slots in said space between said panels disposed to arrest the movement of said slide means when said indicaor is opposite each of said numbers in turn;

said indicator means being disposed for motion in a direction perpendicular to said slots and said stops;

an enlarged section adjacent said indicator means and forming a part of said slide means and being wider than said slots;

said enlarged section forming a ledge upon said slide means and disposed for sliding engagement with said positive stops so that these can be only vertical movement of said enlarged section when said enlarged section is between adjacent pairs of said positive stops in any one series;

spring arms adjoining said enlarged section of said slide means and forming a part thereof;

legs positioned on the end of said spring arms disposed for sliding upon the interior surface of the oppositely spaced panel;

whereby depressing said indicator means causes said enlarged section to clear said positive stops and permits movement of said slide means in a horizontal direction, and releasing said indicator means causes said enlarged section and said indicator to move in a vertical direction between said positive stops thereby positioning said slide and said indicator means in a position opposite any desired one of said members along said slots and providing positive engagement of said indicator in said position.

2. The device of claim 1 including:

a pair of wheels positioned rotatably between said panels so that a portion of their circumference protrudes beyond the outer edge of said device;

said wheels having notches each bearing graduations of 0 through 9 opposite each notch;

spring pawl means disposed to engage said notches;

windows in said panel in register with said numbers on said wheels;

whereby a total score may be indicated on said wheels through said windows by rotating said wheels.

3. The device of claim 2 including means for fastening said device to the person of a player.

4. The device of claim 2 including means for fastening said device to a golf bag.

* * * * *